US007243379B2

(12) United States Patent
Panopoulos

(10) Patent No.: US 7,243,379 B2
(45) Date of Patent: Jul. 17, 2007

(54) MACHINE AND OR A PROCESS THAT WILL PROVIDE SELF CLEANING ADVANCED HOT TUBS, BATHS, AND POOLS, WITH DISPENSING FUNCTIONS AND AUTOMATIC SCRUBBING SYSTEMS

(76) Inventor: Peter John Panopoulos, 9220 S. 87th Ct., Hickory Hills, IL (US) 60457

( * ) Notice: Subject to any disclaimer, the term of this patent is extended or adjusted under 35 U.S.C. 154(b) by 314 days.

(21) Appl. No.: 10/879,672

(22) Filed: Jun. 29, 2004

(65) Prior Publication Data

US 2004/0261167 A1 Dec. 30, 2004

Related U.S. Application Data

(60) Provisional application No. 60/483,830, filed on Jun. 30, 2003.

(51) Int. Cl.
*E04H 4/00* (2006.01)
*A47K 4/00* (2006.01)

(52) U.S. Cl. ..... 4/490; 4/662

(58) Field of Classification Search ..... 4/490, 4/546

See application file for complete search history.

(56) References Cited

U.S. PATENT DOCUMENTS 4,563,780 A * 1/1986 Pollack ..... 4/668
5,381,566 A * 1/1995 Sonesson et al. ..... 4/591
7,090,124 B2 * 8/2006 Wallace et al. ..... 235/380

* cited by examiner

*Primary Examiner*—Charles E. Phillips
(74) *Attorney, Agent, or Firm*—Justin Lampel

(57) ABSTRACT

A self-cleaning advanced hot tub-bath tub, pool with dispensing functions for providing a hot tub with the functionality to automatically cleanse itself and to inject bath oils, perfumes, soaps, bubble baths, medications, and or other items to the hot tub as desired either automatically through memory circuits or manually. A consumer can release bath oils, perfumes, soaps, bubble baths, medications, and or other luxury items to the hot tub as are desired either manually for each individual item desired, or the consumer depresses the automatic setting and the hot tub prepares the bath as automatically set by the consumer from water temperature, to jet cycle time, pressure strength, and which nozzles will be on or off, including what items if any will be injected into the water including but not limited to bath oils, perfumes, soaps, bubble baths, medications, and or other items.

14 Claims, 9 Drawing Sheets

MACHINE AND OR A PROCESS THAT WILL PROVIDE SELF CLEANING ADVANCED HOT TUBS, BATHS, AND POOLS, WITH DISPENSING FUNCTIONS AND AUTOMATIC SCRUBBING SYSTEMS

CROSS REFERENCE TO RELATED APPLICATIONS

This application is based on provisional application Ser. No. 60/483,830, filed on Jun. 30, 2003.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

1. Field of the Invention

This invention relates generally to the field of hot tubs, baths, and pools and more specifically to a machine and or a process that will provide self cleaning advanced hot tubs, baths, and pools, with dispensing functions and automatic scrubbing systems.

The present invention relates generally to advanced hot tub-bath tub, pool with dispensing functions and more specifically it relates to a self-cleaning advanced hot tub-bath tub, pool with dispensing functions, for providing an advanced hot tub and or bath tub with the functionality to automatically cleanse itself and to inject bath oils, perfumes, soaps, bubble baths, medications, and or other luxury items to the bath or the hot tub, bath, or pool as desired by the consumer either automatically through memory circuits when a consumer presses a button or manually. Upon depressing a button, a consumer releases bath oils, perfumes, soaps, bubble baths, medications, and or other luxury items to the bath or the hot tub as are desired either manually for each individual item desired, or the consumer depresses the automatic setting and the hot tub prepares the bath as automatically set by the consumer from water temperature, to jet cycle time, pressure strength, and which nozzles will be on or off, including what items if any will be injected into the water including but not limited to bath oils, perfumes, soaps, bubble baths, medications, and or other luxury items etc.

2. Description of the Related Art

It can be appreciated that hot tubs, bath tubs, and pools have been in use for years. Typically, hot tub-bath tub, pools are comprised of hot tubs, bath tubs, and pools used for bathing and relaxation for leisure, cleansing, and for medical purposes.

The main problem with conventional advanced hot tub-bath tubs, and pools are that they do not have the functionality to automatically clean themselves or sanitize themselves after or before use. Another problem with conventional hot tubs, bath tubs, and pools are that they do not have the automatic functionality to dispense bath oils, bubble bath formulas, liquid soaps, lotions, liquids, powders, flakes, beads, or other ingredients into the water for use by consumers. Another problem with conventional hot tubs, bath tubs, and pools is that they do not have the automatic functionality to allow users to program the bath tub or the hot tub to preset temperature, fill level(s), and jet level(s), and store these setting(s) in different ways in memory for later recall for multiple users.

While these devices may be suitable for the particular purpose to which they address, they are not as suitable for providing an advanced hot tub, bath tub, or pool with the functionality to automatically cleanse itself, scrub itself, and or to heat sanitize itself, and to inject bath oils, perfumes, soaps, bubble baths, medications, and or other luxury items to the bath or the hot tub as desired by the consumer either automatically through memory circuits when a consumer presses a button or manually. Upon depressing a button, a consumer releases bath oils, perfumes, soaps, bubble baths, medications, and or other luxury items to the bath or the hot tub as are desired either manually for each individual item desired, or the consumer depresses the automatic setting and the hot tub prepares the bath as automatically set by the consumer from water temperature, to jet cycle time, pressure strength, and which nozzles will be on or off, including what items if any will be injected into the water including but not limited to bath oils, perfumes, soaps, bubble baths, medications, and or other luxury items etc.

The main problem with conventional hot tubs, bath tubs, and pools is that they do not have the functionality to automatically clean themselves or sanitize themselves after or before use. Another problem is they do not have the automatic functionality to dispense bath oils, bubble bath formulas, liquid soaps, lotions, liquids, powders, flakes, beads, or other ingredients into the water for use by consumers. Also, another problem is they do not have the automatic functionality to allow users to program the bath tub or the hot tub to preset temperature, fill level(s), and jet level(s), and store these setting(s) in different ways in memory for later recall for multiple users.

In these respects, the self-cleaning advanced hot tub-bath tub, pool with dispensing functions according to the present invention substantially departs from the conventional concepts and designs of the prior art, and in so doing provides an apparatus primarily developed for the purpose of providing an advanced hot tub, bath tub, and or pool with the functionality to automatically cleanse, automatically scrub, and automatically heat sanitize itself and to inject bath oils, perfumes, soaps, bubble baths, medications, and or other luxury items to the bath or the hot tub as desired by the consumer either automatically through memory circuits when a consumer presses a button or manually.

Upon depressing button(s), a consumer can release bath oils, perfumes, soaps, bubble baths, medications, and or other luxury items to the bath or the hot tub as are desired either manually for each individual item desired, or the consumer depresses the automatic setting and the hot tub prepares the bath as automatically set by the consumer from water temperature, to jet cycle time, pressure strength, and which nozzles will be on or off, including what items if any will be injected into the water including but not limited to bath oils, perfumes, soaps, bubble baths, medications, and or other luxury items etc.

SUMMARY OF THE INVENTION

In view of the foregoing disadvantages inherent in the known types of advanced hot tub-bath tub, pool with dispensing functions now present in the prior art, the present invention provides a new self-cleaning advanced hot tub-bath tub, pool with dispensing functions construction wherein the same can be utilized for providing an advanced hot tub and or bath tub with the functionality to automatically cleanse itself and to inject bath oils, perfumes, soaps, bubble baths, medications, and or other luxury items to the bath or the hot tub as desired by the consumer either automatically through memory circuits when a consumer presses a button or manually.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of the description and should not be regarded as limiting.

In accordance with a preferred embodiment of the invention, there is disclosed a machine and or a process that will provide self cleaning advanced hot tubs, baths, and pools, with dispensing functions and automatic scrubbing systems.

The general purpose of the present invention, which will be described subsequently in greater detail, is to provide a new self-cleaning advanced hot tub-bath tub, pool with dispensing functions that has many of the advantages of hot tubs, bath tubs, and pools mentioned heretofore and many novel features that result in a new self-cleaning advanced hot tub-bath tub, pool with dispensing functions which is not anticipated, rendered obvious, suggested, or even implied by any of the prior art hot tubs, bath tubs, and or pools, either alone or in any combination thereof.

A primary object of the present invention is to provide a self-cleaning advanced hot tub-bath tub, pool with dispensing functions that will overcome the shortcomings of the prior art devices.

To attain this, the present invention generally comprises a hot tub or bath tub for containing water perforated with holes for the insertion of water-jet nozzles, drains, temperature transducers (sensors), and for providing for the installation of electronic control panels, knobs, buttons, controls, memory, circuitry, power supplies, mechanical and electromechanical parts, dispensing tanks, and electromechanical hot water and cold water valve faucets to attain the temperature desired, and display information.

Upon depressing a button, a consumer releases bath oils, perfumes, soaps, bubble baths, medications, and or other luxury items to the bath or the hot tub as are desired either manually for each individual item desired, or the consumer depresses the automatic setting and the hot tub prepares the bath as automatically set by the consumer from water temperature, to jet cycle time, pressure strength, and which nozzles will be on or off, including what items if any will be injected into the water including but not limited to bath oils, perfumes, soaps, bubble baths, medications, and or other luxury items etc.

Another main component of my invention includes "N" number of dispensing containers of "X" size and "Y" shape with electromechanical dispensing means for dispensing and injecting bath oils, perfumes, soaps, bubble baths, medications, powders, flakes, and or other luxury items to the bath or the hot tub as desired by the consumer.

Another main component of my invention includes an electronic circuit card containing all the logic circuits, the controls, buttons, knobs, and display information, including optional voice activation, that operate the automatic cleansing cycles and the injection of the bath oils, perfumes, soaps, bubble baths, medications, and or other luxury items to the bath or the hot tub as desired by the consumer.

Another main component of my invention is an electromechanical drain-plug that opens and closes the drain that is activated and connected electronically to the circuit mechanism used to drain or to keep a bath electronically as programmed and used during the clean and bath cycles.

Hot tub, bath tub, or pool structure composed primarily out of acrylic, stainless steel, fiberglass or porcelain or other similar structure found in the industry and fashioned with holes for the insertion of water-jet nozzles, drains, temperature transducers (sensors), and for providing for the installation of electronic control panels, knobs, buttons, controls, and display information.

Other main components of the present invention are dispensing containers and related systems. Another main component of my invention includes "N" number of dispensing containers of "X" size and "Y" shape with electromechanical dispensing means for dispensing and injecting bath oils, perfumes, soaps, bubble baths, medications, powders, flakes, and or other luxury items to the bath or the hot tub as desired by the consumer. Another main component of my invention includes an electronic circuit card containing all the logic circuits, the controls, buttons, knobs, and display information, including optional voice activation, that operate the automatic cleansing cycles and the injection of the bath oils, perfumes, soaps, bubble baths, medications, and or other luxury items to the bath or the hot tub as desired by the consumer. Another main component of my invention is an electromechanical drain-plug that opens and closes the drain that is activated and connected electronically to the circuit mechanism used to drain or to keep a bath electronically as programmed and used during the clean and bath cycles.

Another main component is the Electromechanical Cold Water Control Valve. This valve is turned on and off by the logic circuits to automatically adjust the temperature of the water as set by the consumer.

Another main component is the electromechanical hot water control valve. This valve is turned on and off by the logic circuits to automatically adjust the temperature of the water as set by the consumer.

Another main component is the automatic scrubber which Is an automatic scrubbing device that scrubs the bottom and sides of the hot tub, bath, and or pool, that can be placed into the hot tub, bath, or pool manually by the consumer or commercial user.

Another main component of my invention includes an electronic circuit card containing all the logic circuits, the controls, buttons, knobs, and display information, including optional voice activation, that operate the automatic cleansing cycles and the injection of the bath oils, perfumes, soaps, bubble baths, medications, and or other luxury items to the bath or the hot tub as desired by the consumer.

Another main component of my invention is an electromechanical drain-plug that opens and closes the drain that is activated and connected electronically to the circuit mechanism used to drain or to keep a bath electronically as programmed and used during the clean and bath cycles.

An object of the present invention is to provide a self-cleaning advanced hot tub-bath tub, pool with dispensing functions for providing an advanced hot tub and or bath tub with the functionality to automatically cleanse itself and to inject bath oils, perfumes, soaps, bubble baths, medications, and or other luxury items to the bath or the hot tub as desired by the consumer either automatically through memory circuits when a consumer presses a button or manually. Upon depressing a button, a consumer releases bath oils, perfumes, soaps, bubble baths, medications, and or other luxury items to the bath or the hot tub as are desired either manually for each individual item desired, or the consumer depresses the automatic setting and the hot tub prepares the bath as automatically set by the consumer from water temperature, to jet cycle time, pressure strength, and which nozzles will be on or off, including what items if any will be injected into the water including but not limited to bath oils, perfumes, soaps, bubble baths, medications, and or other luxury items etc.

Another object is to provide a self-cleaning advanced hot tub-bath tub, pool with dispensing functions that will allow hot tubs and bath tubs to allow themselves to automatically clean themselves before and or after each use through electromechanical and or heat-sanitizing means. In this embodiment of the invention, when the cleanse cycle is activated, the hot tub or the bath tub will utilize logic circuits that will open the hot water valve while simultaneously closing the drain through a electromechanical drain stop so no water will be lost down the drain pipe.

The hot tub or the bath tub will then fill up with hot water to a fill line, "X" distance from the bottom of the tub, until it hits a water sensor which will then trigger a dispenser that will release bleach, detergents, soaps, chemicals, or or other cleaning agents into the water sufficient in amount(s) to cleanse the tub. After the bleach or the cleaning agents have been dispensed from reservoir tubs through electromechanical controlled injection means, the whirlpool jets will automatically turn on to circulate the bleach throughout the tub and through the jets throughout the hot tub or the bath tub system to cleanse the entire system for a period of "Y" time sufficient enough for proper cleansing for the size of the hot tub or bath tub taking into account the temperature of the water which may help decrease the time involved if the temperature of the water is hot enough to kill microbes and viruses and organisms. After sufficient time has elapsed the hot tub or bath tub will then open its drain valve and drain the water containing the bleach or cleansing agents completely, then it will flush the system with fresh water by closing the drain valve again filling the hot tub with water again (with the option of using cold or hot water for flushing), running the jets again for a period of time just above the fill line for a period of time, and then again it will open the drain valve after a period of time lapses draining the tub. Additional cleanse cycles and rinses can also be programmed.

The duration of the cleanse cycle and the duration of the rinse cycle can also be programmed to vary. The temperature variation chosen for the cleanse cycle can also be chosen in a selective manner. Also there will be logic circuits to warn customers if the temperature of the water is too low for proper or suggested premium cleansing for chemicals chosen and the circuitry buttons and the programmability to allow for programming and adding new chemicals and temperatures and deleting others, and having a default list.

Another object is to provide a self-cleaning advanced hot tub-bath tub, pool with dispensing functions that will contain logic circuits to enable the hot tub to flush the hot tub or the bath tub from soaps or after use waters that need to be flushed, after the tub is used, to clean the tub.

Another object of my invention is to heat sanitize or chemically sanitize the hot tub or bath tub by introducing bleach or other agents into the water through dispensing tanks electromechanically introduced into the hot tub or the bath tub through controlled logic circuits upon activation by the consumer. A further embodiment and object of the invention if to have memory capability to store "X" number of memory settings for consumers to use for different members of the family for entering personal desired setting selections for heat, selected whirlpool action, low, medium, high, pulse, continuous, other variant settings, the system can select which jets to turn on and off, which to be low, medium, high, each can have totally different settings, time the jets will be on, clean time, flush time, bath time, pre-bath time, and other, (ie. such as for using the hot tub as a keg for holding ice for a party.).

Another object is to provide a self-cleaning advanced hot tub-bath tub, pool with dispensing functions that will contain dispensing containers of "N" number and "Y" size, used to contain bath oils, perfumes, soaps, bubble baths, medications, and or other luxury items, that can be built-into the bath or the hot tub as desired with the option of each dispenser having removable dispensing chambers so they can be flushed out to be cleaned from the hot tub whereby the dispensers dispense controlled amounts of contents into the hot tub, bath, or pool in controlled ways.

Another object of my invention is to provide logic circuits that will automatically dispense the bath oils, perfumes, soaps, bubble baths, medications, and or other luxury items, that will be added to the bath or the hot tub as the consumer activates the hot tub or the bath tub by depressing a button or activating it through voice activation means.

Another embodiment and object of my invention is to provide the functionality to include the option in the memory of the circuits of the hot tub or the bath tub of a selector for what ingredients each person "N" of the family would like to add into the water, whatever is selected on each person's list would then be added from the dispensing tanks, through electromechanical injection means (none of the dispensable items, or nothing can also be selected).

Another object of my invention is to provide logic circuits that will enable a hot tub or a bath tub to have dispensing tanks that will allow a consumer to operate the dispensing tanks each separately in manual mode and or to add extra amounts of bath oils, perfumes, soaps, bubble baths, medications, and or other luxury items to the water of the hot tub or the bath tub as desired beyond the automatic setting, in manual mode. Another object is to provide a self-cleaning advanced hot tub-bath tub, pool with dispensing functions that contains logic circuits connected to the appropriate temperature transducers placed into appropriate places in the hot tub or bath tub to sense the water continually to give accurate readings to maintain the water temperature as desired as set by the user(s) in automatic and manual modes and in memory settings.

Another object of my invention is to provide logic circuits that will alert consumer or the commercial user audibly, by email, phone via a voice message, by pager, and by LCD display on the hot tub, bath, or pool what the temperature of the pool is and when the pool when the pool has achieved its set temperature. Another object of my invention is to provide a device that will allow you to set the temperature and to control the operations of the hot tub, bath, or pool and all of its automated features remotely through a wireless remote and or by phone, or cellular phone or mobile phone or a wireless programmable digital assistant or a wireless connected or a land-line connected or directly connected laptop or computer.

Another object is to provide a self-cleaning advanced hot tub-bath tub, pool with dispensing functions that contains logic circuits that will allow the consumer to automatically put the hot tub or the bath tub on an automatic calendar/clock cleaning schedule that will automatically trigger the hot tub or the bath to clean itself on an automatic basis every period selected: on particular dates and times, every day, once a week, once every 2 weeks, once every 3 weeks, once a month, once every 2 months, once every 3 months, (or any other schedule), or to be activated manually.

Another object is to provide a self-cleaning advanced hot tub-bath tub, pool with dispensing functions that contains a logic circuit that when a program is selected to create a certain temperature of water, the unit will start pouring hot water into the hot tub or the bath tub first for hot water to reach the tub first and calibrate the thermometer setting before the hot tub or the bath tub sends the signal to electronically activate the electromechanical drainplug to close to start retaining the water at the correct temperature. The hot tub will then adjust more or less hot and or cold water automatically to control the temperature of the water.

Another object is to provide a self-cleaning advanced hot tub-bath tub, pool with dispensing functions having an automatic scrubber that can be placed into the hot tub, bath or pool manually to automatically scrub the bottom and the sides of the tub or pool, when the hot tub, pool, or bath is in cleansing mode.

The consumer, or the commercial user would just place the automatic waterproof scrubber into the hot tub, bath, or pool submersing it into the hot water or the automatic waterproof scrubber would automatically randomly run about the floor of the hot tub, bath or pool automatically and scrub the floor during the cleansing cycle. If the water is not hot enough, the logic of the system will give off an alert visually and audibly via an LCD readout and or other means. It will also display a warning if cleansing agents are not in the water by utilizing a sensor in the cleansing agents' dispensing tanks when they are low. The system may be made to sense and display what cleansing agents are in the water and what are to be used by the system by prompting the user as to what can be used when disinfectants and cleaning agents are low. Other objects and advantages of the present invention will become obvious to the reader and it is intended that these objects and advantages are within the scope of the present invention and to the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

BRIEF DESCRIPTION OF THE DRAWINGS

Figure 1:
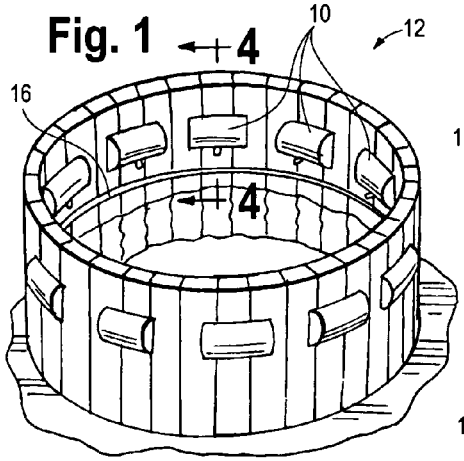

Various other objects, features and attendant advantages of the present invention will become fully appreciated as the same becomes better understood when considered in conjunction with the accompanying drawings, in which like reference characters designate the same or similar parts throughout the several views, and wherein:

FIG. <1> is a perspective view of a hot tub, bath or pool showing removable dispensing tanks for bath oils, shampoos, conditioners, medications, antibacterial agents, antiviral agents, antimicrobial agents, cleaning agents, chlorine, cleaning agents, chemicals, etc.; of the present invention.

FIG. <2> is a fragmentary perspective of the hot tub, bath or pool with dispensing tanks mounted outside of the tub.

FIG. <3> is a readout/control panel for use with dispensing tanks and for controlling the functions of the invention.

FIG. <4> is a cross-section of the hot tub, bath or pool taken along at lines 4-4 from FIG. 1 of the invention.

Figure 2:
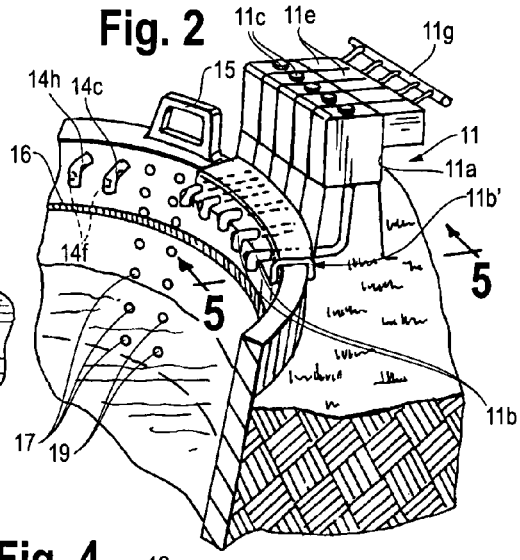

FIG. <5> is a cross-section of the hot tub, bath or pool taken along lines 5-5 from FIG. 2 of the invention.

FIG. <6> is a fragmentary perspective of the interior of the hot tub, bath or pool with modular accessory panels.

FIG. <7A> is one embodiment of an electromechanical drain plug system for use in a hot tub, bath or pool shown in the full position.

FIG. <7B> is an embodiment of 7A of the electromechanical drain plug system shown in the drain position.

FIG. <7C> is another embodiment of an electromechanical drain plug system for use in a hot tub, bath or pool shown in the draining or emptying position.

FIG. <7D> is an embodiment of 7C of the electromechanical drain plug system shown in holding or fill position.

FIG. <8> is one embodiment of an automatic scrubbing device for the hot tub, bath or pool of the present invention.

FIG. <9> is another embodiment of an automatic scrubbing device for the hot tub, bath or pool of the present invention.

FIG. <10> is a perspective view of the hot tub, bath or pool showing input interface panels.

FIG. <11> is the "Flowchart Diagram For Cleaning The Hot Tub, Bath, Or Pool".

FIG. <12> is the "Circuit Logic Block Diagram For Cleaning The Hot Tub, Bath, Or Pool".

FIG. <13> is the "Circuit Logic Block Diagram For Dispensing Operations For The Hot Tub, Bath, Or Pool".

FIG. <14> is the "Circuit Logic Block Diagram For Filling The Hot Tub, Bath, Or Pool".

FIG. <15> is the "Memory Allocation Logic Block Diagram For The Hot Tub, Bath, Or Pool".

FIG. <16> is the "Flowchart For Filling The Hot Tub, Bath, Or Pool".

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

DETAILED DESCRIPTION OF THE INVENTION

Turning now descriptively to the drawings, in which similar reference characters denote similar elements throughout the several views, the attached figures illustrate a self-cleaning advanced hot tub-bath tub, pool with dispensing functions, which comprises a hot tub, bath, or pool for containing water perforated with holes for the insertion of water-jet nozzles, drains, temperature transducers (sensors), and for providing for the installation of electronic control panels, knobs, buttons, controls, and display information.

FIG. 1 depicts a hot tub, bath or pool 12; showing removable electromechanical dispensing tanks 10 that have wired connections to the hot tub, bath or pool's logic systems that drive dispensing functions to dispense bath oils, shampoos, conditioners, medications, antibacterial agents, antiviral agents, antimicrobial agents, cleaning agents, chlorine, cleaning agents, chemicals, through automatic controls, or through manual pushbutton means, or to operate through automatic presets for automatic bath presets as described in the present invention to operate through a selection of modes whereby a user may dispense contents into the water or on themselves manually or automatically through presets by depressing buttons on the control panel of the hot tub, bath, or pool or on the dispenser(s) or by utilizing other input means such as wireless inputs means, voice activation or other input means either while water is being filled or after water has filled up to the fill line 16.

FIG. 2 depicts a hot tub, bath or pool 11 with a plurality of independently removable dispensing tanks 11*a* (that can be removed for cleaning or replacement) mounted outside of the hot tub, bath or pool, which also can be built into the hot tub, bath, or pool and be made to be accessible for filling and removal for washing and cleaning; having dispensing pump motors 11*e;* and cables or wires 11*g* that connect the pump motors to the logic or circuits of the hot tub bath or pool; with dispensing caps 11*c* on the dispensing tanks 11*a* that can be removed to fill the dispensing tanks; said dispensing tanks having dispensing faucets or tubes 11*b* that empty into the hot tub, bath or pool or to the user; said hot tub, bath, or pool also having a control panel 15; water temperature sensor(s) 17 and water level sensor(s) 19 that proceed from the bottom of the hot tub, bath, or pool to the top either in an array or as one singular unit (an array is shown in the drawing) to detect water temperature(s) and water level(s) for the function(s) of the advanced hot tub, bath or pool; also shown are an electromechanical cold water faucet 14*c* and an electromechanical hot water faucet 14*h* that can add cold and hot water as needed to vary the temperature of the water as needed to maintain the temperature settings desired also having water flow rate sensor(s) 14*f* built into said electromechanical hot and cold water faucets.

Figure 3:
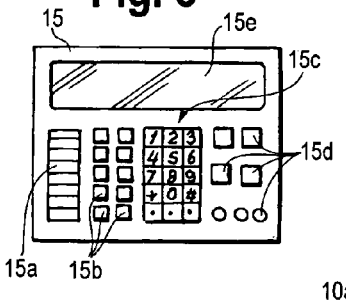

FIG. 3 depicts a control panel interface that can be used to control the functions of the advanced self cleaning and dispensing and filling functions of the hot tub, bath or pool and to control the water level functions and the other functions of the system and it should be noted that other types of panels and layouts can be used however this is an illustration to be used as a guideline whereby there is an LCD or other readout panel 15*e* built into the control panel 15 that prompts the user while programming the system and or displays messages for operating the system and to provide online help as needed when the user asks for help; there are buttons to save personal settings 15*a* (to save water temperature, water levels desired, jet selection, jet pressure, jet cycle time, bath time, clean cycles as to schedule(s) for cleaning, cleaning cycle data as to how to clean the tub and all the parameters, dispensing data for each bath saved, etc.); buttons 15*b* (to choose what dispensing tanks to activate or pump contents out of in manual mode or to select when in programming mode); a numeric keypad (which can be expanded to be alphanumeric) 15*c* (to enter programming information for cleaning cycles when prompted for date/time or to draw a bath automatically as desired to have a bath ready as desired at one's personal settings); mode, programming, help, and power switches 15*d* to allow a user select from Filling, Dispensing, Cleaning, & Programming Modes, and to Turn On the System or to put the hot tub, bath or pool in stand by mode that it may run in program mode and that a user may push a button for help to view instructions on how to use the hot tub, bath or pools features on the LCD readout panel of the control panel 15*e*.

Figure 4:
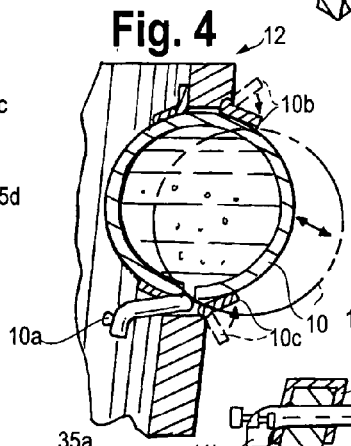

FIG. 4 depicts a cross-section of the hot tub, bath or pool 12 showing a removable electromechanical dispensing tank 10 for bath oils, shampoos, conditioners, medications, antibacterial agents, antiviral agents, antimicrobial agents, cleaning agents, chlorine, cleaning agents, chemicals, etc.; of the present invention having attachment means 10*b* and 10*c* that allow the attachment and removal of the dispensing tank(s) into wells of the hot tub, bath or pool said dispensing tank also having a dispensing faucet or tube 10*a*.

Figure 5:
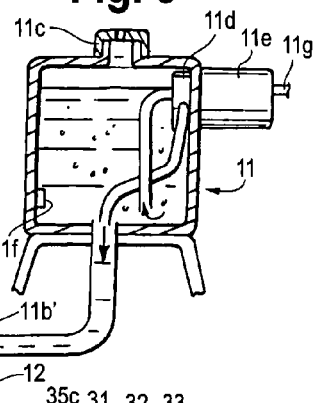

FIG. 5 depicts an electromechanical dispensing tank system 11 with a dispensing cap 11*c* that can be removed to fill the dispensing tank, said dispensing tank having hoses that feed a pump motor feed wheel 11*d* connected to a pump motor 11*e* which then connects to a dispensing faucet or tube 11*b* whereby also the dispensing system's pump motor is also connected to a cable or a wire 11*g* that connects to the logic or the circuits of the hot tub, bath or pool that drive the dispensing systems mechanisms automatically or manually as a user desires.

Figure 6:
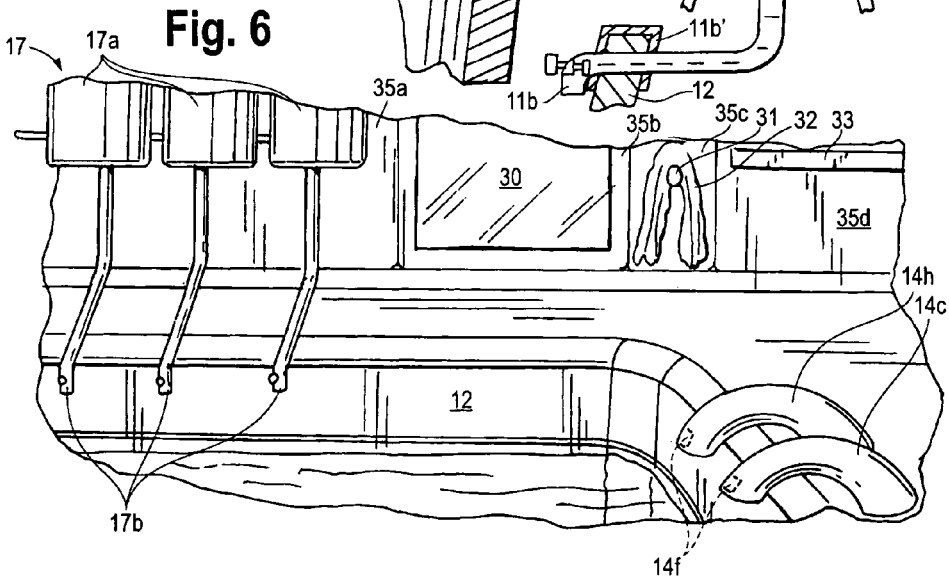

FIG. 6 depicts the hot tub, bath or pool with a series of modular accessory panels namely a dispenser modular accessory panel 35*a* (having one or more dispensers 17*a* in it with dispensing faucets or tubes 17*b* with electronic connections that connect it to the electronics of the hot tub, bath or pool; a mirror accessory panel 30 (that can be exchanged to be an flat panel television or an AM/FM radio that can either be stationary or rise up from automatically upon a user depressing a button for use through a electromechanisms) a washcloth or towel module 35*c* having one or more washcloth or towel hook(s) 31 in it showing a washcloth or towel on it 32; a shelving unit module having one or more shelves 33 in it whereby the drawing shows the hot tub, bath or pool 12 with an electromechanical hot water faucet 14*h* and an electromechanical cold water faucet 14*c* both having water flow rate sensor(s) 14*f*.

Figure 7A:
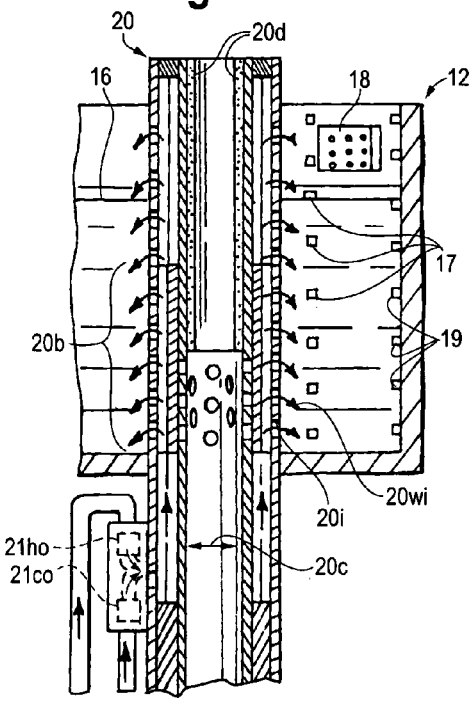

FIG. 7A depicts one embodiment of the electromechanical drain plug system for use in a hot tub, bath or pool shown in the full position whereby the electromechanical drain plug pictured has the capability to allow water to flow through it to fill or empty the hot tub, bath or pool. Pictured are electromechanical hot and cold water inlet valves that are controlled by the logic of the hot tub, bath or pool to fill the hot tub, bath or pool where water flows upwardly 20*wi* (water in) to fill the hot tub, bath or pool through the sleeve of a pipe that connects to a perforated pipe 20*i* (in) whose center contains a solenoid system 20*d* that has a plunger that is actuated to close and or open the drain as needed. When the hot tub, bath or pool is filling the plunger 20*b* is lowered into the drain of 20*c* to seal off the holes pictured so water will not go down the drain. When water is to be drained the solenoid is activated to pull the plunger upwardly and out of the holes of 20*c* to let water flow down the drain. Also pictured is a control panel 18 and water temperature sensor(s) 17 and water level sensor(s) 19 that proceed from the bottom of the hot tub, bath, or pool to the top either in an array or as one singular unit (an array is shown in the drawing) to detect water temperature(s) and water level(s) for the function(s) of the advanced hot tub, bath or pool. Also pictured is a water fill line 16.

Figure 7C:
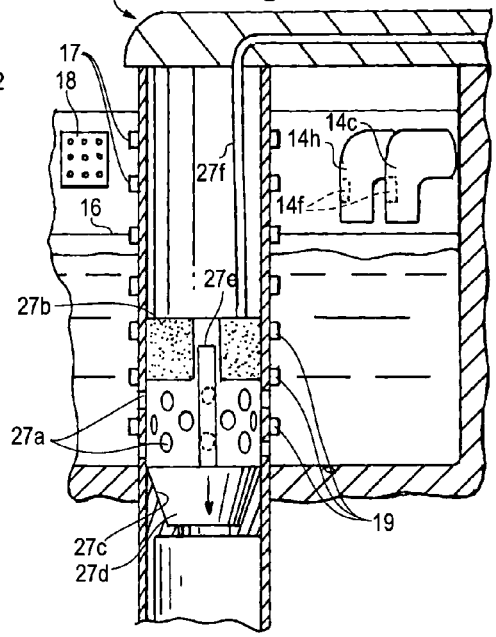
Figure 7B:
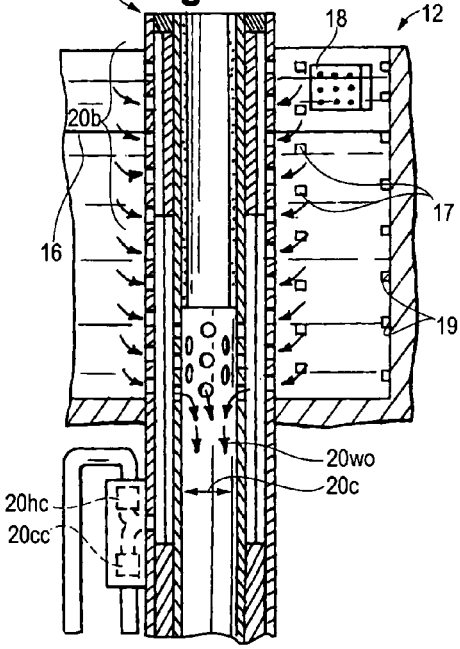

FIG. 7B depicts another embodiment of the electromechanical drain plug system for use in a hot tub, bath or pool shown in the emptying or drain position whereby the electromechanical drain plug pictured has the capability to allow water to flow through it to fill or empty the hot tub, bath or pool. Pictured are electromechanical hot and cold water inlet valves that are controlled by the logic of the hot tub, bath or pool to fill the hot tub, bath or pool where water can flow in to fill the hot tub bath or pool; however pictured in this drawing water is shown to flow downwardly 20*wo* (water out) to empty the hot tub, bath or pool while the plunger of the solenoid system is in the up position allowing the water to escape into the drain. Whereby there is a perforated pipe 20 whose center contains a solenoid system that has a plunger that is actuated to open and to drain as needed as is shown in this drawing. When the hot tub, bath or pool is filling the plunger 20*b* is lowered into the drain of 20*c* to seal off the holes pictured so water will not go down the drain. When water is to be drained the solenoid is activated to pull the plunger upwardly and out of the holes of 20*c* to let water flow down the drain. Also pictured is a control panel 18 and water temperature sensor(s) 17 and water level sensor(s) 19 that proceed from the bottom of the hot tub, bath, or pool to the top either in an array or as one singular unit (an array is shown in the drawing) to detect water temperature(s) and water level(s) for the function(s) of the advanced hot tub, bath or pool. Also pictured is a water fill line 16.

FIG. 7C is another embodiment of an electromechanical drain plug system 27 for use in a hot tub, bath or pool shown to keep the hot tub bath or pool at a certain water level by keeping the water drain closed and preventing the draining of the hot tub, bath or pool showing a pipe or a rodlike electromechanical drainplug with an electromechanical actuator mechanism or solenoid system 27*b* that connects to a stem 27*e* that connects to a plunger 27*d* that seals off the drain sealing off holes 27*a* putting the plunger into position to sit in position 27*c* by the solenoid or actuator mechanism 27*b*. The solenoid or actuator mechanism is connected to the logic circuits of the hot tub, bath or pool through a cable 27*f*. Also pictured is a control panel 18 and water temperature sensor(s) 17 and water level sensor(s) 19 that proceed from the bottom of the electromechanical drain plug to the top of it either in an array or as one singular unit (an array is shown in the drawing) to detect water temperature(s) and water level(s) for the function(s) of the advanced hot tub, bath or pool. Further pictured is an electromechanical cold water faucet valve 14*c* and an electromechanical hot water valve 14*h* both having water flow rate sensor(s) 14*f*. Also pictured is a water fill line 16.

Figure 7D:
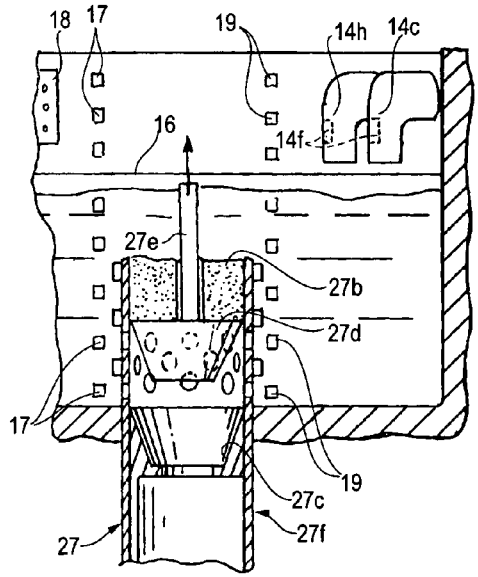

FIG. 7D is another embodiment of an electromechanical drain plug system for use in a hot tub, bath or pool shown emptying the hot tub bath or pool by draining the hot tub, bath or pool showing a pipe or a rodlike electromechanical drainplug with an electromechanical actuator mechanism or solenoid system 27*b* that connects to a stem 27*e* that connects to a plunger 27*d* that has been actuated in the "up" position to open the holes 27*a* to put the plunger into a position furthest away from position 27*c* by the solenoid or actuator mechanism 27*b* to empty the hot tub, bath, or pool. The solenoid or actuator mechanism is connected to the logic circuits of the hot tub, bath or pool through a cable 27*f*. Also pictured is a control panel 18 and water temperature sensor(s) 17 and water level sensor(s) 19 that proceed from the bottom of the hot tub, bath, or pool to the top either in an array or as one singular unit (an array is shown in the drawing) to detect water temperature(s) and water level(s) for the function(s) of the advanced hot tub, bath or pool. Further pictured is an electromechanical cold water faucet valve 14*c* and an electromechanical hot water valve 14*h* both having water flow rate sensor(s) 14*f*. Also pictured is a water fill line 16. The electromechanical drain plug rodlike mechanism can be any length and can be manufactured to be developed to 1) be secured and fit underneath the hot tub, bath or pool; 2) to fit solely inside the drain; 3) to fit inside the drain and extend up through the water and to the top of the hot tub, bath or pool 4) and have optional water level and water temperature sensors built into it.

Figure 8:
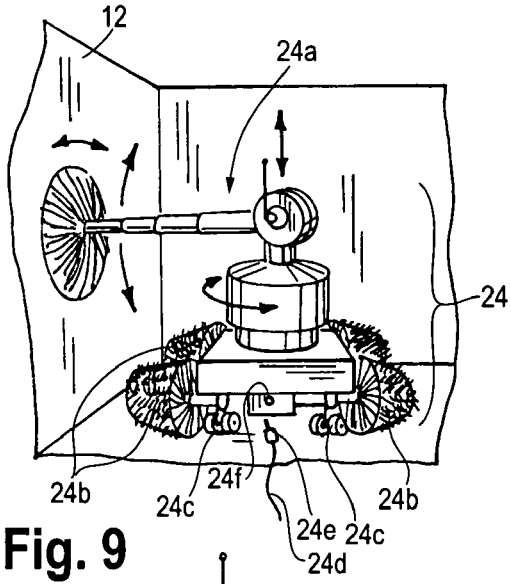

FIG. 8 is one embodiment of an automatic scrubbing device 24 for the hot tub, bath or pool 12 comprised of a telescopic wall scrubbing arm 24*a* that can rotate in all directions, extend, and move up and down having an antennae for control means and or an optional waterproof secure cable connector 24*f* and cable accessory 24*d* to connect the automatic scrubber to control circuits of the hot tub, bath or pool of the present invention. Further pictured are scrubbing brushes 24*b* and programmable automatic directional wheels 24*c*. A control panel is also contained on the autoscrubber (not pictured) said autoscrubber also has optional battery systems onboard (if not powered and controlled by a cable) whereby all systems, control panels, and circuits and mechanisms are waterproof and immune to detergents and chemicals.

Figure 9:
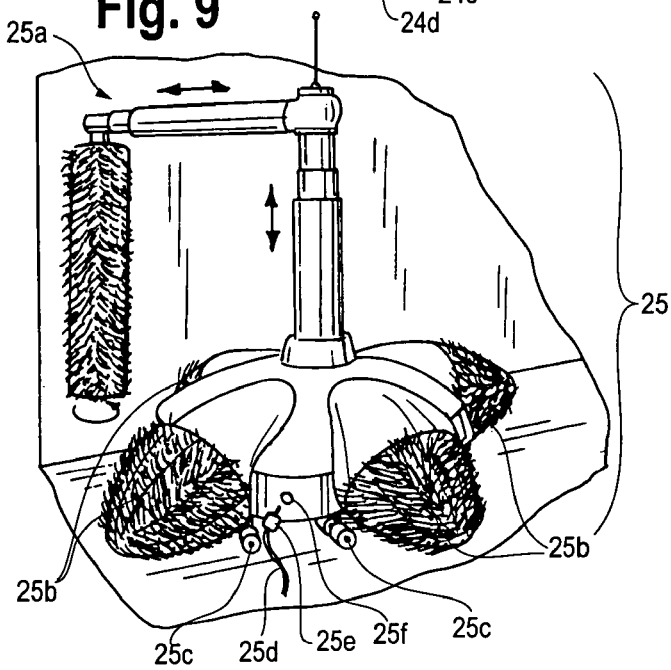

FIG. 9 is another embodiment of an automatic scrubbing device 25 for the hot tub, bath or pool comprised of a telescopic wall scrubbing arm 25*a* that can rotate in all directions, extend, and move up and down having an antennae for control means and or an optional waterproof secure cable connector 25*f* and cable accessory 25*d* to connect the automatic scrubber to control circuits of the hot tub, bath or pool of the present invention. Further pictured are scrubbing brushes 25*b* and programmable automatic directional wheels 25*c*. A control panel is also contained on the autoscrubber (not pictured) said autoscrubber also has optional battery systems onboard (if not powered and controlled by a cable) whereby all systems, control panels, and circuits and mechanisms are waterproof and immune to detergents and chemicals.

Figure 10:
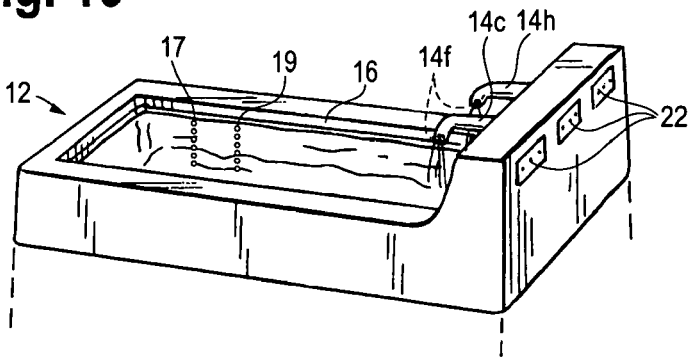

FIG. 10 depicts the hot tub, bath or pool 12 showing input interface panels 22 having the functionality to allow inputs for phone, computer, wireless remote, voice activation, manual input(s), programmed input(s), or other input connectivity. Further pictured is an electromechanical cold water faucet valve 14*c* and an electromechanical hot water valve 14*h* both having water flow rate sensor(s) 14*f*. Also pictured is a water fill line 16. Also pictured are water temperature sensor(s) 17 and water level sensor(s) 19 that proceed from the bottom of the hot tub, bath or pool to the top either in an array or as one singular unit (an array is shown in the drawing) to detect water temperature(s) and water level(s) for the function(s) of the advanced hot tub, bath or pool.

Figure 11:
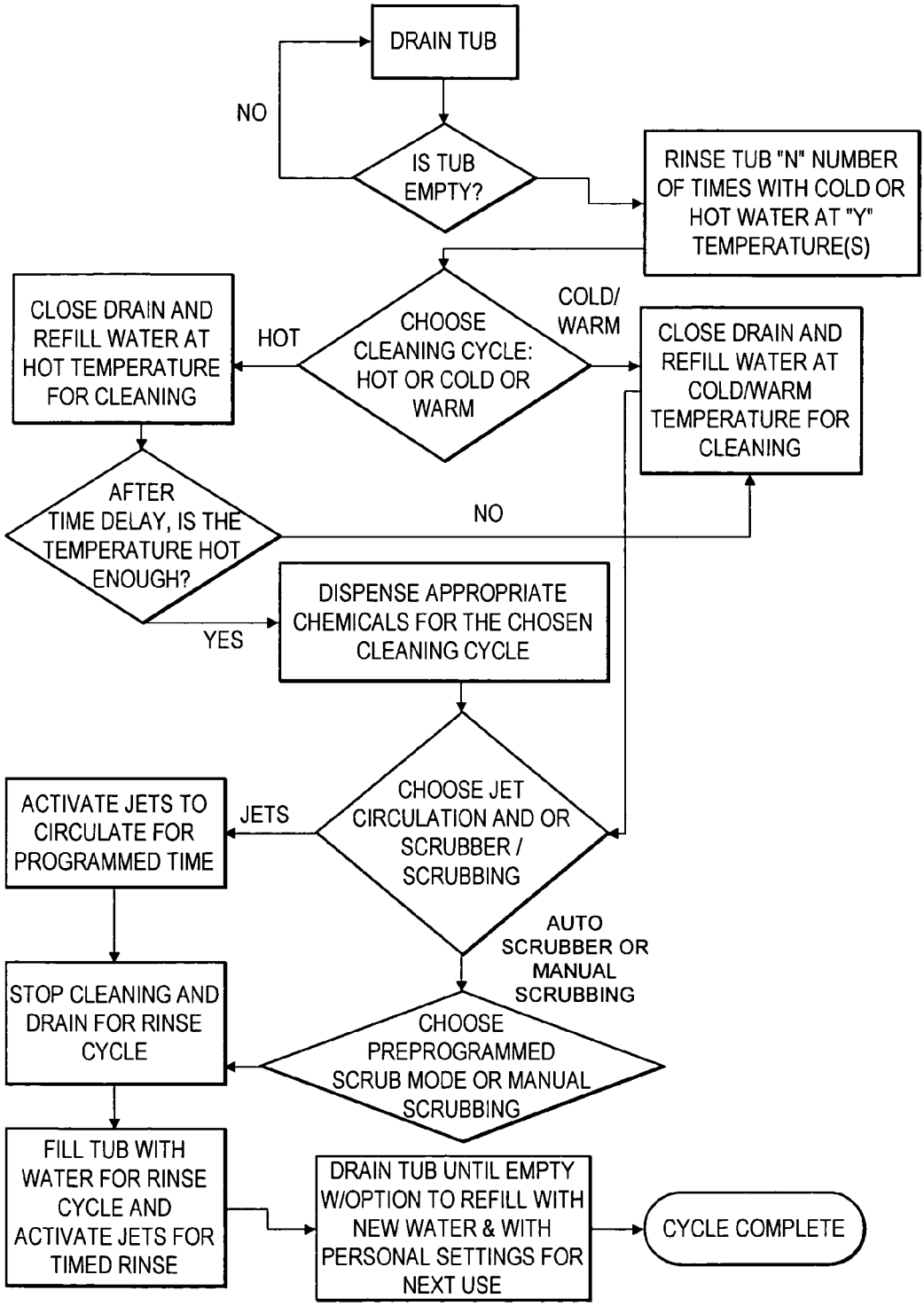

FIG. 11 depicts the "Flowchart Diagram For Cleaning The Hot Tub, Bath, Or Pool". The cleaning cycle of the hot tub, bath or pool is as follows:

1) The user starts the clean cycle through a number of input means as indicated in the circuit diagrams and the logic asks whether or not the tub is empty whereby sensor(s) determine if there is water in the hot tub, bath or pool. The logic loops until the tub, bath or pool is empty.

2) The next option is to rinse the hot tub, bath or pool one or more times as is desired by the user (the number of times with hot or cold water and at what temperature to rinse is programmable).

3) The logic then allows the user to program the system to choose a hot or cold/warm cleaning cycle.

4) If a hot cleaning cycle is chosen the electromechanical drainplug is closed and the system fills the hot tub, bath or pool with hot water for cleaning and the system chooses hot water dispensing chemicals to sanitize the hot tub, bath or pool; if a cold/warm cycle is chosen where the water was not hot enough for proper heat sanitation then the electromechanical drainplug is closed automatically and the hot tub, bath or pool is filled with water at the lesser cold/warm water temperature(s) and a cold/warm dispensers are chosen to release cold/warm dispensing chemicals to sanitize the hot tub, bath or pool. In either case the system waits long enough to see whether the water temperature is hot or cold/warm to make the determination to use hot or cold/warm sanitation chemicals.

5) Further, jets are then turned on to circulate the cleansing agents throughout the hot tub, bath or pool for a programmed time selected by the user whereby the cleansing agents can be disinfectants, bleach, chlorine, detergents, antibacterials, antimicrobials, antiviral agents, soaps, chemicals, heat sanitizing agents, cold sanitizing agents, or other cleaning agents, whereby an automatic scrubber can also be immersed into the hot tub, bath or pool while these agents are added for a thorough cleaning until the cleaning mode terminates, whereby then the user is prompted to remove the auto-scrubber through audio-visual means and the hot tub, bath or pool then is automatically drained and then filled with water where then the jets activate to engage the system in a rinse cycle for a programmed period of time whereupon completion the system then drains the hot tub, bath or pool until empty with the option to refill the hot tub, bath or pool with fresh or new water with personal settings for next use terminating the cleanse cycle.

Figure 12:
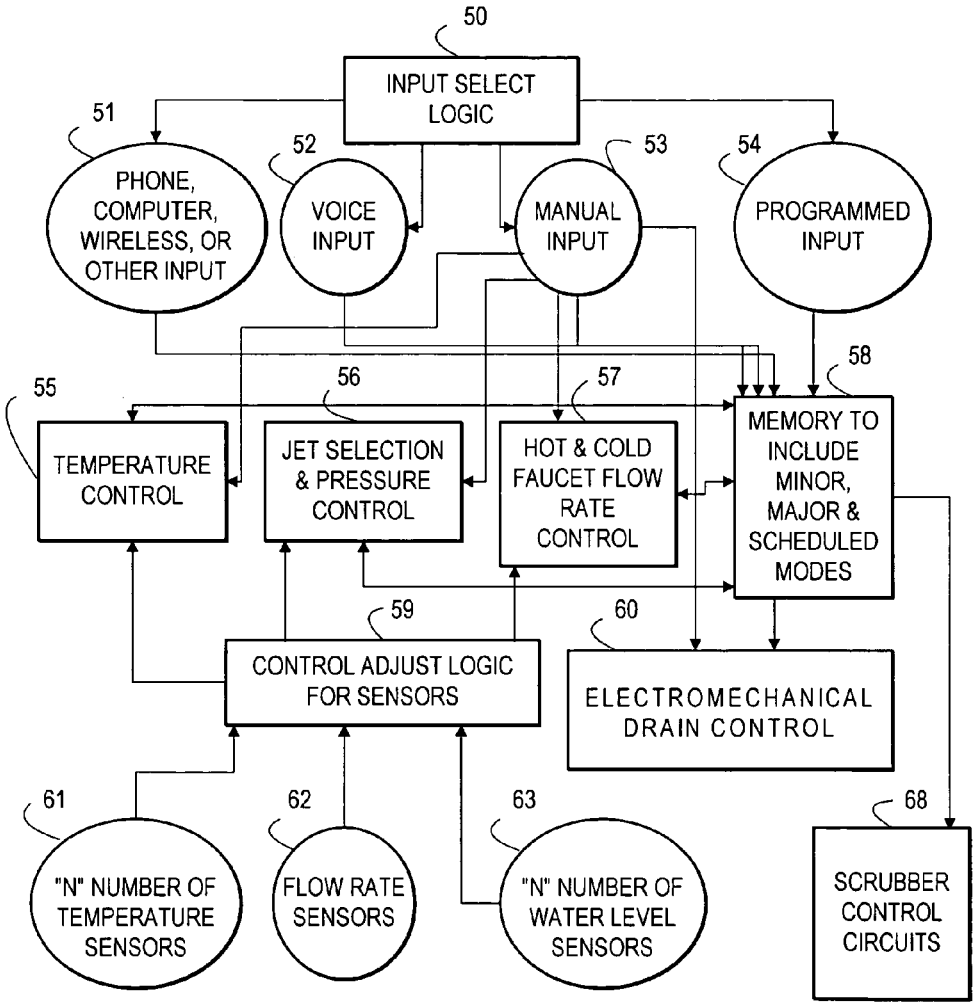

FIG. 12 depicts the "Circuit Logic Block Diagram For Cleaning The Hot Tub, Bath, Or Pool". This circuit is comprised of: "Input Select Logic" 50 that allows the hot tub, bath or pool system to be controlled by: "Phone, Computer, Wireless, Or Other Input" 51 control means; or to be controlled by: "Voice Input" 52 control means; or to be controlled by: "Manual Input" 53 control means; or to be controlled by: "Programmed Input" 54 control means; whereas inputs 51, 52, 53, and 54 can be input into: "Memory To Include Minor, Major And Scheduled Modes" (for different modes of cleaning) 58; whereby memory also schedules scrubbing modes through the: "Scrubber Control Circuits" 68; and whereby cleaning modes can be saved for further recall and where personal cleaning settings and cycles and controls can be assigned to passwords and or alphanumeric characters to adjust temperature settings operating through a: "Temperature Control" 55; where jet selection and jet pressure controls can be saved to memory through: "Jet Selection & Pressure Control" 56; where water temperature can be controlled through the: "Hot And Cold Faucet Flow Rate Control" 57; where water level control by controlling the: "Electromechanical Drain Control" 60 through automatic memory settings or by manual override means as desired; also having: "Control Adjust Logic For Sensors" 59; connecting to: "N" Number Of "Temperature Sensors" 61; "Flow Rate Sensors" 62 and "N" Number Of "Water-Level Sensors" 63.

Figure 13:
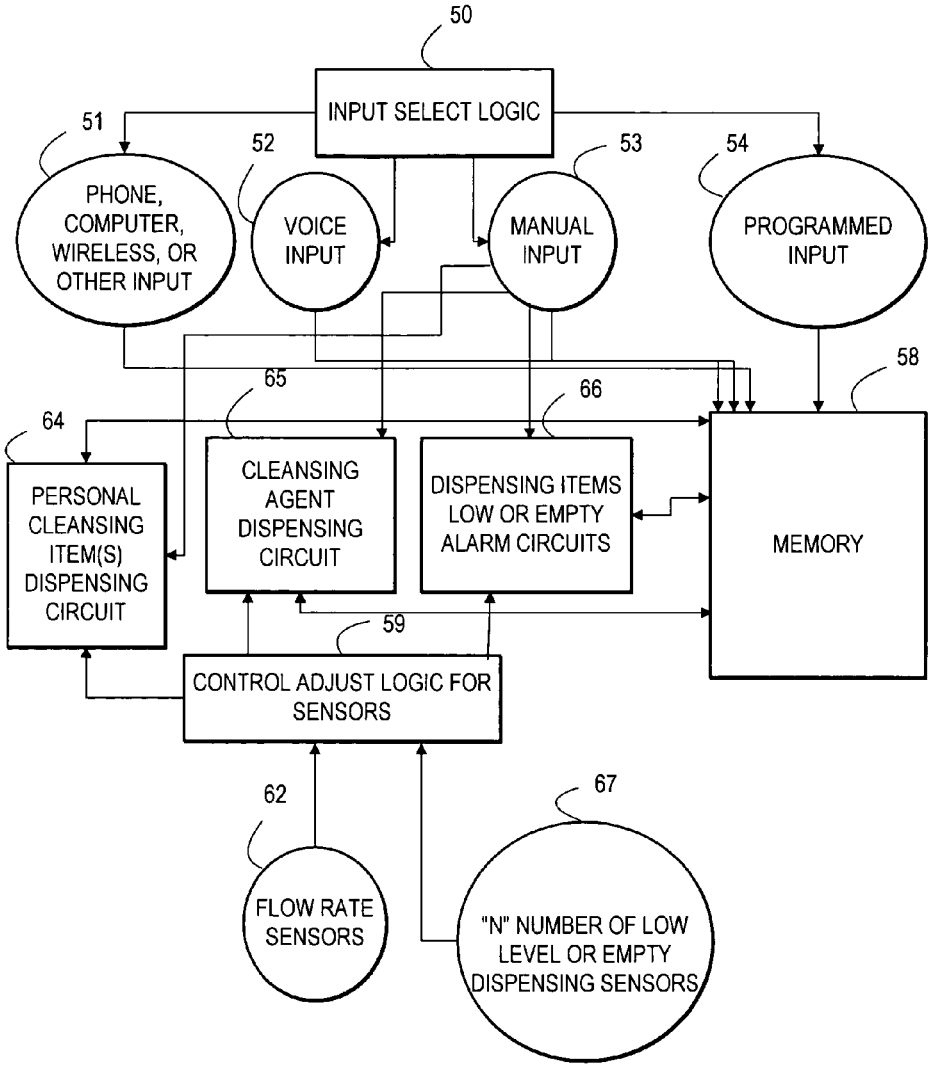

FIG. 13 depicts the "Circuit Logic Block Diagram For Dispensing Operations For The Hot Tub, Bath, Or Pool". This circuit is comprised of: "Input Select Logic" 50 that allows the hot tub, bath or pool system to be controlled by: "Phone, Computer, Wireless, Or Other Input" 51 control means; or to be controlled by: "Voice Input" 52 control means; or to be controlled by: "Manual Input" 53 control means; or to be controlled by: "Programmed Input" 54 control means; whereas inputs 51, 52, 53, and 54 can be input into: "Memory" 58 and saved for further recall where personal settings and controls can be assigned to passwords and or alphanumeric characters to adjust dispensing settings through memory or through manual means as indicated; where memory controls give warning(s) to users through audio-visual means when dispensing tanks are low or empty through the: "Dispensing Items Low Or Empty Alarm Circuits" 66; where memory controls the: "Cleansing Agent Dispensing Circuit" 65; where memory controls the: "Personal Cleansing Item Dispensing Circuit" 64 to dispense the item(s) desired or where manual means override the automatic memory setting(s); with: "Control Adjust Logic For Sensors" 59; connecting to: "Flow Rate Sensors" 62 and to "N" Number Of "Low-Level Or Empty Dispensing Sensors" 67.

Figure 14:
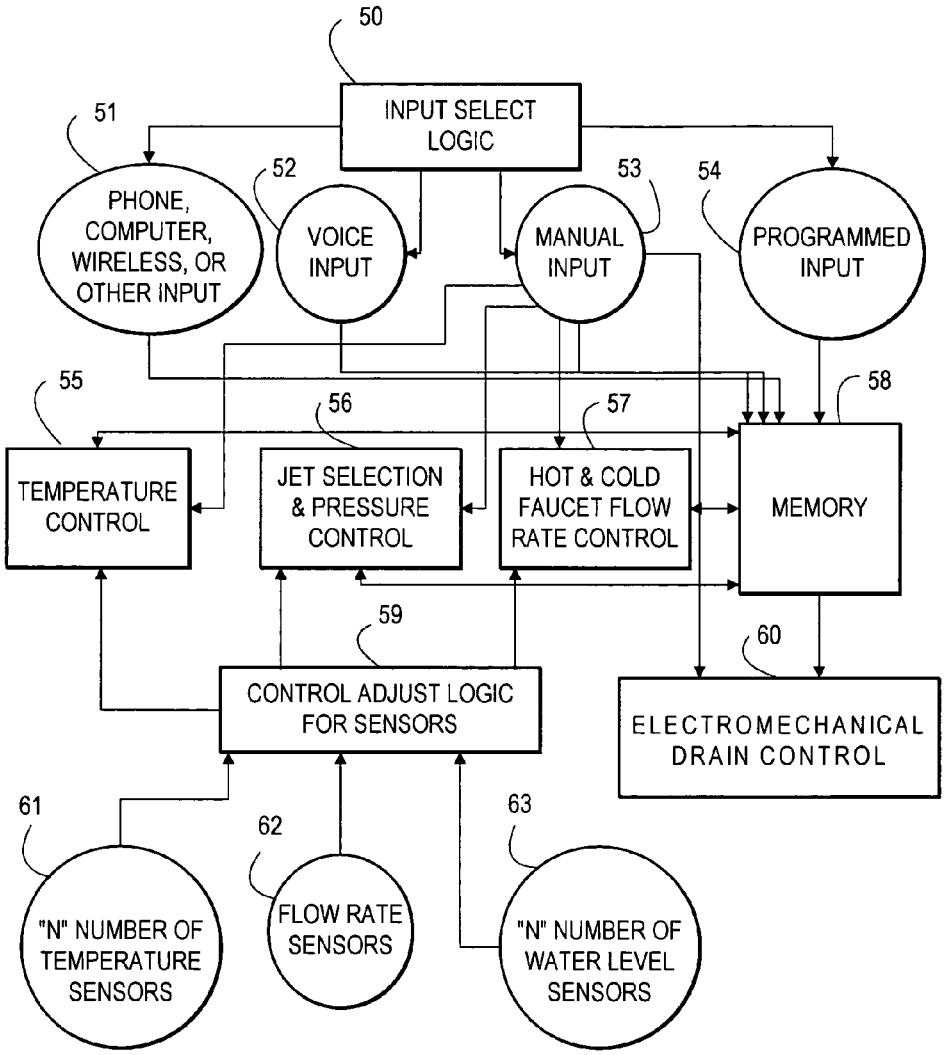

FIG. 14 depicts the "Circuit Logic Block Diagram For Filling The Hot Tub, Bath, Or Pool". This circuit is comprised of: "Input Select Logic" 50 that allows the hot tub, bath or pool system to be controlled by: "Phone, Computer, Wireless, Or Other Input" 51 control means; or to be controlled by: "Voice Input" 52 control means; or to be controlled by: "Manual Input" 53 control means; or to be controlled by: "Programmed Input" 54 control means; whereas inputs 51, 52, 53, and 54 can be input into: "Memory" 58 and saved for further recall and where personal settings and controls can be assigned to passwords and or alphanumeric characters to adjust temperature settings operating through a: "Temperature Control" 55; where jet selection and jet pressure controls can be saved to memory through: "Jet Selection & Pressure Control" 56; where water temperature can be controlled through the: "Hot And Cold Faucet Flow Rate Control" 57; where water level control by controlling the: "Electromechanical Drain Control" 60 through automatic memory settings or by manual override means as desired; also having: "Control Adjust Logic For Sensors" 59; connecting to: "N" Number Of "Temperature Sensors" 61; "Flow Rate Sensors" 62 and "N" Number Of "Water-Level Sensors" 63.

Figure 15:
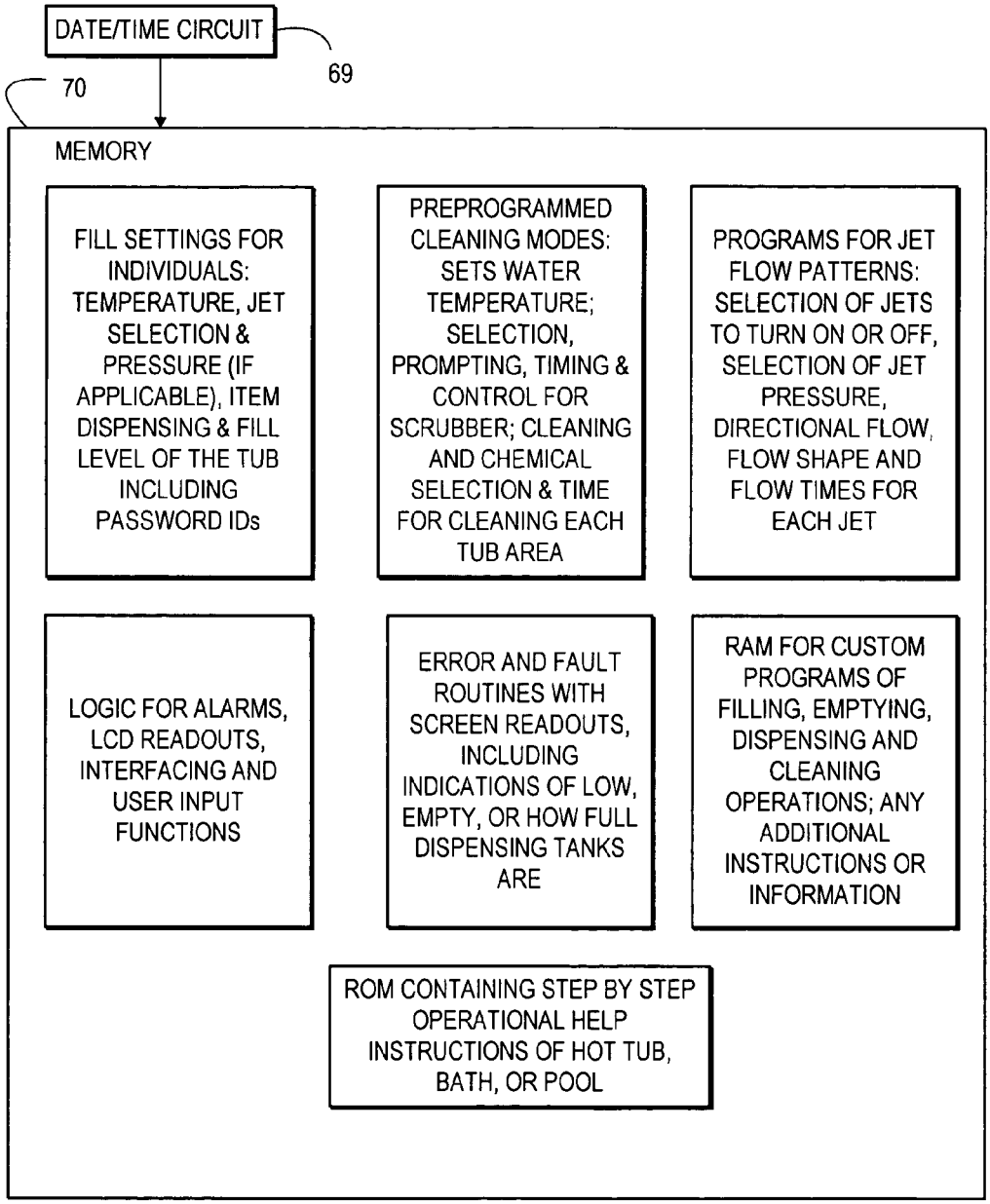

FIG. 15 depicts the "Memory Allocation Logic Block Diagram For The Hot Tub, Bath, Or Pool". The "Memory Allocation Logic Block Diagram" is comprised of a: "Date/Time Circuit" 69 that allows the hot tub, bath or pool to drive and schedule all its functions automatically according to a date and time as desired by user(s); and "Memory" 70 which allows functions to be remembered as user(s) wish to save their setting(s) for later recall. Memory includes but is not limited to the following settings, modes, programs, routines, readouts, RAM and features: a) "Fill settings for individuals: temperature, jet pressure (if applicable), liquid dispensing combination and fill level of the tub including password Ids; b) Pre-programmed cleaning modes: sets water temperature; selection, prompting, timing and control for scrubber; cleaning chemical selection & time for cleaning each tub area; c) Programs for jet flow patterns: selection of jet pressure, directional flow, flow shape and flow times for each jet; d)

Logic for alarms, LCD readouts, interfacing and user input functions; e) Error and fault routines with screen readouts, including indications of low or empty dispensing tanks; f) RAM for custom programs of filling, emptying, dispensing, and cleaning operations; any additional instructions or information.

Figure 16:
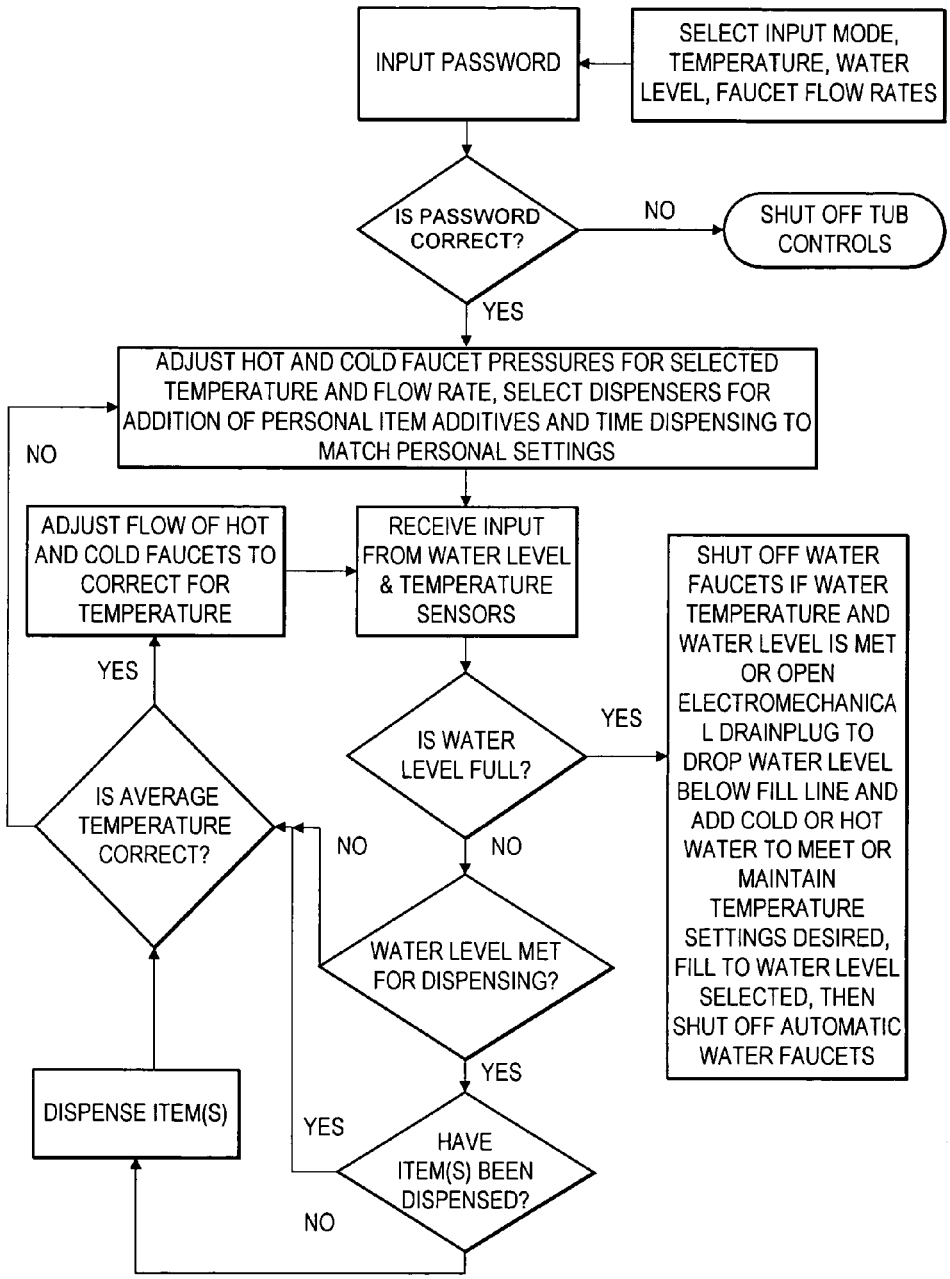

FIG. 16 depicts the "Flowchart For Filling The Hot Tub, Bath, Or Pool".

The process depicted in the flowchart for filling the hot tub, bath or pool is as follows:

1) Starting the Filling Cycle the hot tub, bath or pool first enters into an input mode where temperature, water level and faucet flow rates are selected.
2) There is an option for a user to enter a password for automatic personal settings to be chosen to draw a bath or to start a cleanse cycle. If the password or ID is incorrect the hot tub, bath or pool controls are shut off; if the password or ID is correct then the hot and cold faucet pressures for selected water temperature and flow rate are automatically adjusted though the aid of logic and water temperature sensor(s) placed throughout the system, dispenser(s) are selected as are programmed to dispense item(s) selected into the tub, bath or pool for times selected as programmed for personal settings.
3) Levels and temperature are checked from sensors to determine water level and water temperature from sensor(s).
4) If water level is full the system shuts off automatic electromechanical water faucets if water temperature and water level is met or it opens the electromechanical drainplug to drop the water level below the fill line to add cold and or hot water to meet or maintain temperature settings desired, then it fills the hot tub, bath or pool to water level selected, then it shuts off the automatic water faucets.
5) When the water level is at the threshold dispensing items into the water as programmed then it proceeds to dispense the item(s) selected by the user into the water; otherwise it cycles and keeps on filling the hot tub, bath or pool with water until that threshold level is reached and then it dispenses the items when the threshold is met.
6) The filling cycle also continually checks to see if the temperature has been met that the user has programmed the unit for; if not it cycles to adjust the hot and the cold water by adding water to maintain the water temperature setting that the user has set the system to maintain. If the water level raises to the fill line and the system has not met the appropriate temperature the system will automatically adjust by emptying water below the fill line, then it will close the drain plug automatically and add hot or cold water to adjust the temperature as needed and cycle to maintain the temperature desired.

Another main component of my invention includes "N" number of dispensing containers of "X" size and "Y" shape with electromechanical dispensing means for dispensing and injecting bath oils, lotions, perfumes, soaps, bubble baths, medications, powders, flakes, and or other items, luxury items to the pool, bath or the hot tub as desired by the consumer.

Another main component of my invention includes an electronic circuit card containing all the logic circuits, the controls, buttons, knobs, and display information, including optional voice activation, that operate the automatic cleansing cycles and the injection of the bath oils, lotions, perfumes, soaps, bubble baths, medications, and or other luxury items to the bath or the hot tub as desired by the consumer.

Another main component of my invention is an electromechanical drain-plug that opens and closes the drain that is activated and connected electronically to the circuit mechanism used to drain or to keep a bath electronically as programmed and used during the clean and bath cycles.

Hot tub, bath tub, or pool structure composed primarily out of acrylic, stainless steel, fiberglass or porcelain or other similar structure found in the industry and fashioned with holes for the insertion of water-jet nozzles, drains, temperature transducers (sensors), and for providing for the installation of electronic control panels, knobs, buttons, controls, LCD panel, and display information.

Dispensing containers. Another main component of my invention includes "N" number of dispensing containers of "X" size and "Y" shape with electromechanical dispensing means for dispensing and injecting bath oils, perfumes, soaps, bubble baths, medications, powders, flakes, and or other luxury items to the bath or the hot tub as desired by the consumer.

Another main component of my invention includes an electronic circuit card containing all the logic circuits, the controls, buttons, knobs, and display information, including optional voice activation, that operate the automatic cleansing cycles and the injection of the bath oils, perfumes, soaps, bubble baths, medications, and or other luxury items to the bath or the hot tub as desired by the consumer.

Another main component of my invention is an electromechanical drain-plug that opens and closes the drain that is activated and connected electronically to the circuit mechanism used to drain or to keep a bath electronically as programmed and used during the clean and bath cycles. Electromechanical Cold Water Control Valve. This valve is turned on and off by the logic circuits to automatically adjust the temperature of the water as set by the consumer. Electromechanical Hot Water Control Valve. This valve is turned on and off by the logic circuits to automatically adjust the temperature of the water as set by the consumer. The Automatic Scrubber is an automatic scrubbing device that scrubs the sides and the bottom of the hot tub, bath, and or pool, that can be placed into the hot tub, bath, or pool manually by the consumer or commercial user to automatically clean the hot tub, bath or pool after it has been programmed for the particular tub, bath or pool it is placed in.

Hot tub, bath tub, or pool structure composed primarily out of stainless steel, fiberglass or porcelain or other similar structure found in the industry and fashioned with holes for the insertion of water-jet nozzles, drains, temperature transducers (sensors), and for providing for the installation of electronic control panels, knobs, buttons, controls, and display information. The hot tub or bath tub is a shell design tub much like other tubs on the market with holes cut out for the drain, water jets, temperature transducer sensors, control knobs, buttons, display information, and plumbing. Different shapes and materials can be used as are common in the industry.

Dispensing Containers. Another main component of my invention includes "N" number of dispensing containers of "X" size and "Y" shape with electromechanical dispensing means for dispensing and injecting bath oils, perfumes, soaps, bubble baths, medications, powders, flakes, and or other luxury items to the bath or the hot tub as desired by the consumer. The dispensing containers of the hot tub can be made out of any material so that they can be inert and non-reactive with the contents that will be put inside. Many different types of plastic can be used of different shapes and sizes and number to be placed inside or outside of the unit or with a door for easy access to fill the containers with whatever is desired: bath oils, perfumes, soaps, bubble baths, medications, powders, flakes, and or other luxury items, that can be added to the bath or the hot tub as desired by the consumer. The dispensing containers can be made of different materials: plastics, metals, glass, etc.; and can be in different sizes and shapes. The electromechanical means that are used to dispense the contents of the containers can vary in their quality level and can be designed to pump small amounts or high-volume-amounts of ingredients into the hot tub.

Another main component of my invention includes an electronic circuit card containing all the logic circuits, the controls, buttons, knobs, and display information, including optional voice activation, that operate the automatic cleansing cycles and the injection of the bath oils, perfumes, soaps, bubble baths, medications, and or other luxury items to the bath or the hot tub as desired by the consumer.

The self-cleaning circuit card contains all the logic circuits of the hot tub or the bath tub required for automatic date-time cleaning, or for interval periodic cleaning by day, week, bi weekly, tri-weekly, monthly, bimonthly, or tri-monthly, or manual cleaning, and or for dispensing agents from the dispensing containers into the water as desired. The circuit card can have all the logic circuits on one card or the circuits can be broken up into multiple circuit cards, having multiple buttons, knobs, displays, etc.

Another main component of my invention is an electromechanical drain-plug that opens and closes the drain that is activated and connected electronically to the circuit mechanism used to drain or to keep a bath electronically as programmed and used during the clean and bath cycles. The "electromechanical drain plug" of the "advanced hot tub, bath, or pool" is used to open and close the drain that is activated and connected electronically to the circuit mechanism used to drain or to keep a bath electronically as programmed and used during the clean and bath cycles. The drain plug is an electromechanical device connected to the circuit card made out of metal and or plastic with electromechanical parts, such as a solenoid, designed to open or close, and to stop or let water through, to retain water, or let water flow through the drain pipe when open.

Electromechanical Cold Water Control Valve. This valve is turned on and off, and to dispense more or less cold water by the logic circuits to automatically adjust the cold water temperature of the water as set by the consumer, by adding more or less cold water as may be needed to adjust the temperature of the water as set by the consumer. The electromechanical cold water valve is an electromechanical device connected to the circuit card made out of metal and or plastic with electromechanical parts designed to open or close, and to stop or let cold water through, to pour water into the tub, or let water flow into the tub when open.

Electromechanical Hot Water Control Valve. This valve is turned on and off by the logic circuits to automatically adjust the temperature of the water as set by the consumer. This valve is turned on and off, and to dispense more or less hot water by the logic circuits to automatically adjust the hot water temperature of the water as set by the consumer by adding more or less hot water as may be needed to adjust the temperature of the water as set by the consumer. The electromechanical hot water valve is an electromechanical device connected to the circuit card made out of metal and or plastic with electromechanical parts designed to open or close, and to stop or let hot water through, to pour water into the tub, or let water flow into the tub when open.

The automatic scrubber is an automatic scrubbing device that scrubs the bottom of the hot tub, bath, and or pool, that can be placed into the hot tub, bath, or pool manually by the consumer or commercial user. The automatic scrubber can be any size and shape and it can be designed to move about in patterns to scrub the entire area in a random manner or in a programmed manner to clean the entire area of the hot tub, bath, or the pool.

The arms or the automatic scrubber can be made to extend so as to scrub up and down the sides of the bath tub, the hot tub, or the pool to reach all areas. Different materials can be used in the auto-scrubber, mainly electromechanical and waterproof parts with circular cylindrical scrub brushes having one or more brush design heads that can spin and rotate with wheels that can move and direct the automatic scrubber to navigate on the tub, bath or pool floor in a programmably directed motion to clean the tub, bath or pool and or said scrubber designed with other one or more variable brush designs made to spin and scrub the tub and not to scratch the tub but to clean it, utilizing chemicals, bleaches, and things known in the janitorial industries.

The logic circuits operate in a fashion to allow a consumer to automatically clean a hot tub or a bath tub by having the hot tub or bath tub: 1) open its electromechanical drain plug to drain the tub, 2) flush the tub with hot water through the hot tub's water jets and through it's electromechanical cold and hot water valves for a period of time, 3) close the drain plug via the electromechanical drain plug, 4) fill the hot tub or bath tub with hot water for sanitizing to fill line, 5) introduce bleach or sanitizing or chemical cleansing agents, and while the tub, bath or pool is in cleansing mode the system will optionally either prompt the consumer to manually scrub the tub, bath or pool by hand, or it will prompt the user to activate the automatic scrubber and manually introduce the automatic scrubber into the hot tub, bath, or pool and place the automatic scrubber into the hot tub, bath or the pool 6) activate water jets to circulate deep cleansing action for a programmed time, 7) drain tub by opening electromechanical drain plug, 8) flush tub again with water jets, 9) fill tub with water above fill line and circulate again lower to fill line (tub is ready for next bath). Other interconnections relating to the hot tub, bath and pool include the logic circuits that allow the hot tub, bath, and or pool to control all its operations including the controllable operations mentioned relating to the optional dispensing containers of the hot tub, bath tub, and or pool, that will allow the consumer or the commercial user to add items to the bath or the hot tub or the pool as mentioned as desired, and control circuits thereof and the mechanisms and circuits to control the cleanse cycle. The hot tub, bath tub or pool can be designed in any size or shape and in a wide variety of materials including but not limited to stainless steel, fiberglass, porcelain, and to other materials known in the art and in the industry.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed:

1. An improved pool/bath tub providing automatic and pre-set filling, cleaning and scrubbing functions, comprising in combination:

a pool/bath tub structure having side walls and a bottom wall;

hot and cold water valves to control the dispensing of hot and cold water into said pool/bath tub;

a plurality of dispensing tanks associated with said pool/bath tub structure and in fluid communication therewith, each of said dispensing tanks containing a segregated ingredient for dispensing into said pool/bath tub;

a pool/bath tub control means electronically interconnected to said dispensing tanks for controlling the dispensing of said segregated ingredients into said pool/bath tub and interconnected to said hot and cold water valves for controlling the filling of said pool/bath tub with hot and cold water;

a drain plug system incorporated in said pool/bathtub for automatically draining and filling said pool/bath tub, and at least one readout control panel associated with said pool/bathtub control means, said readout control panel containing all data relating to dispensing segregated ingredients into said pool/bath tub in a programmed manner, and being in electronic communication with said drain plug system automatically affecting the alternately draining and filling of said pool/bath tub, whereby said control means may be programmed by said readout control panel to control the filling of said pool/bath tub with hot and cold water and dispensing any one of said segregated ingredients into said pool/bath tub as desired by the operator, said drain plug system includes control means for automatically draining and filling said pool/bath tub, said control means being electronically interconnected to said hot and cold water means to control the filling and draining of said pool/bath tub, and said control means including a user readout panel to display all program data therein and allow a user to select and control all filling and dispensing functions contained in said readout control panel incident to the use of said pool/bath tub, wherein said pool/bath tub includes a scrubber system for placement in said pool/bath tub to perform a cleaning and scrubbing function relative to said pool/bath tub; said scrubber system including means for effecting the movement of said scrubber system with said pool/bath tub, said scrubber system further provided with control means electronically interconnected to said scrubber system for controlling the cleaning and scrubbing operation of said scrubber system; and said control means being electronically interconnected to said pool/bath tub control in order to permit said readout control panel to accept programmed data for the cleaning and scrubbing operation and permit the operator to program and control the cleaning and scrubbing operation and review such data on the user readout control panel.

2. The pool/bath tub of claim 1 wherein the readout panel allows the user to input, edit, program and select predefined settings and to control dispensing tanks and control the functions of the invention.

3. The pool/bath tub of claim 1 further comprising:

water temperature sensors and water level sensors electronically connected to the readout control panel.

4. The pool/bath tub of claim 1 wherein the readout control panel requires the entering of a personal identification number prior to functioning.

5. The pool/bath tub of claim 1 wherein the readout control panel is electronically connected to a telephone.

6. The pool/bath tub of claim 1 wherein the readout control panel controls the flow of water into and out of the tub.

7. The pool/bath tub of claim 1 wherein the readout control panel is electronically connected and capable of voice recognition.

8. The pool/bath tub of claim 1 wherein the readout control panel responds to signals received from a wireless device.

9. The pool/bath tub of claim 1 wherein programmable and editable information is stored, saved and edited in and through memory and can be retrieved and utilized to control the readout control panel and the functions of the pool/bath tub.

10. The pool/bath tub of claim 1 further comprising:

an alarm electronically connected to the readout control panel.

11. The pool/bath tub of claim 1 further comprising:

an LCD screen displayed on the readout control panel.

12. An improved pool/bath tub providing automatic and pre-set filling, cleaning and scrubbing functions, comprising in combination:

a pool/bath tub structure having side walls and a bottom wall;

hot and cold water valves to control the dispensing of hot and cold water into said pool/bath tub;

a plurality of dispensing tanks associated with said pool/bath tub structure and in fluid communication therewith, each of said dispensing tanks containing a segregated ingredient for dispensing into said pool/bath tub;

a pool/bath tub control means electronically interconnected to said dispensing tanks for controlling the dispensing of said segregated ingredients into said pool/bath tub and interconnected to said hot and cold water valves for controlling the filling of said pool/bath tub with hot and cold water;

a drain plug system incorporated in said pool/bathtub for automatically draining and filling said pool/bath tub, and at least one readout control panel associated with said pool/bathtub control means, said readout control panel containing all data relating to dispensing segregated ingredients into said pool/bath tub in a programmed manner, and being and being an electronic communication with said drain plug system automatically affecting the alternately draining and filling of said pool/bath tub, whereby said control means may be programmed by said readout control panel to control the filling of said pool/bath tub with hot and cold water and dispensing any one of said segregated ingredients into said pool/bath tub as desired by the operator, said drain plug system includes control means for automatically draining and filling said pool/bath tub, said control means being electronically interconnected to said hot and cold water means to control the filling and draining of said pool/bath tub, and said control means including a user readout panel to display all program data therein and allow a user to select and control all filling and dispensing functions contained in said readout control panel incident to the use of said pool/bath tub, wherein said pool/bath tub includes a scrubber system for placement in said pool/bath tub to perform a cleaning and scrubbing function relative to said pool/bath tub; said scrubber system including means for effecting the movement of said scrubber system with said pool/bath tub, said scrubber system further provided with control means electronically interconnected to said scrubber system for controlling the cleaning and scrubbing operation of said scrubber system, said control means being electronically interconnected to said pool/bath tub control in order to permit said readout control panel to accept programmed data for the cleaning and scrubbing operation and permit the operator to program and control the cleaning and scrubbing operation and review such data on the user readout control panel; and wherein said scrubber system is provided with a plurality of brush arms positioned thereon in order to effect the cleaning and scrubbing of said pool/bath tub including the side walls and bottom wall thereof.

13. An improved pool/bath tub providing automatic and pre-set filling, cleaning and scrubbing functions, comprising in combination:

a pool/bath tub structure having side walls and a bottom wall;

hot and cold water valves to control the dispensing of hot and cold water into said pool/bath tub;

a plurality of dispensing tanks associated with said pool/bath tub structure and in fluid communication therewith, each of said dispensing tanks containing a segregated ingredient for dispensing into said pool/bath tub;

a pool/bath tub control means electronically interconnected to said dispensing tanks for controlling the dispensing of said segregated ingredients into said pool/bath tub and interconnected to said hot and cold water valves for controlling the filling of said pool/bath tub with hot and cold water;

a drain plug system incorporated in said pool/bathtub for automatically draining and filling said pool/bath tub, and at least one readout control panel associated with said pool/bathtub control means, said readout control panel containing all data relating to dispensing segregated ingredients into said pool/bath tub in a programmed manner, and being and being an electronic communication with said drain plug system automatically affecting the alternately draining and filling of said pool/bath tub, whereby said control means may be programmed by said readout control panel to control the filling of said pool/bath tub with hot and cold water and dispensing any one of said segregated ingredients into said pool/bath tub as desired by the operator, said drain plug system includes control means for automatically draining and filling said pool/bath tub, said control means being electronically interconnected to said hot and cold water means to control the filling and draining of said pool/bath tub, and said control means including a user readout panel to display all program data therein and allow a user to select and control all filling and dispensing functions contained in said readout control panel incident to the use of said pool/bath tub, wherein said pool/bath tub includes a scrubber system for placement in said pool/bath tub to perform a cleaning and scrubbing function relative to said pool/bath tub; said scrubber system including means for effecting the movement of said scrubber system with said pool/bath tub, said scrubber system further provided with control means electronically interconnected to said scrubber system for controlling the cleaning and scrubbing operation of said scrubber system, said control means being electronically interconnected to said pool/bath tub control in order to permit said readout control panel to accept programmed data for the cleaning and scrubbing operation and permit the operator to program and control the cleaning and scrubbing operation and review such data on the user readout control panel;

wherein said scrubber system is provided with a plurality of brush arms positioned thereon in order to effect the cleaning and scrubbing of said pool/bath tub including the side walls and bottom wall thereof; and wherein said scrubber system is provided with a plurality of wheels to accommodate the movement of said scrubber system within said pool/bath tub and permits said scrubber system to move throughout the entire perimeters of side walls and bottom wall of said pool/bath tub.

14. An improved pool/bath tub providing automatic and pre-set filling, cleaning and scrubbing functions, comprising in combination:

a pool/bath tub structure having side walls and a bottom wail;

hot and cold water valves to control the dispensing of hot and cold water into said pool/bath tub;

a plurality of dispensing tanks associated with said pool/bath tub structure and in fluid communication therewith, each of said dispensing tanks containing a segregated ingredient for dispensing into said pool/bath tub;

a pool/bath tub control means electronically interconnected to said dispensing tanks for controlling the dispensing of said segregated ingredients into said pool/bath tub and interconnected to said hot and cold water valves for controlling the filling of said pool/bath tub with hot and cold water;

a drain plug system incorporated in said pool/bathtub for automatically draining and filling said pool/bath tub, and at least one readout control panel associated with said pool/bathtub control means, said readout control panel containing all data relating to dispensing segregated ingredients into said pool/bath tub in a programmed manner, and being and being an electronic communication with said drain plug system automatically affecting the alternately draining and filling of said pool/bath tub, whereby said control means may be programmed by said readout control panel to control the filling of said pool/bath tub with hot and cold water and dispensing any one of said segregated ingredients into said pool/bath tub as desired by the operator, said drain plug system includes control means for automatically draining and filling said pool/bath tub, said control means being electronically interconnected to said hot and cold water means to control the filling and draining of said pool/bath tub, and said control means including a user readout panel to display all program data therein and allow a user to select and control all filling and dispensing functions contained in said readout control panel incident to the use of said pool/bath tub, wherein said pool/bath tub includes a scrubber system for placement in said pool/bath tub to perform a cleaning and scrubbing function relative to said pool/bath tub; said scrubber system including means for effecting the movement of said scrubber system with said pool/bath tub, said scrubber system further provided with control means electronically interconnected to said scrubber system for controlling the cleaning and scrubbing operation of said scrubber system;

said control means being electronically interconnected to said pool/bath tub control in order to permit said readout control panel to accept programmed data for the cleaning and scrubbing operation and permit the operator to program and control the cleaning and scrubbing operation and review such data on the user readout control panel; and wherein said user readout control panel is provided with operator controlled buttons to accommodate the operator to program the filling, draining, dispensing and scrubbing functions into said readout control panel thereby to effect the automatic functioning of said pool/bath tub.

* * * * *